US007096850B2

(12) United States Patent
Yashirodai et al.

(10) Patent No.: US 7,096,850 B2
(45) Date of Patent: Aug. 29, 2006

(54) FOUR-CYCLE INTERNAL COMBUSTION ENGINE

(75) Inventors: Tadao Yashirodai, Kakogawa (JP); Kazuhiko Takemoto, Kakogawa (JP)

(73) Assignee: Kawasaki Jukogyo Kabushika Kaisha, Hyogo (JP)

( * ) Notice: Subject to any disclaimer, the term of this patent is extended or adjusted under 35 U.S.C. 154(b) by 310 days.

(21) Appl. No.: 10/755,636

(22) Filed: Jan. 12, 2004

(65) Prior Publication Data

US 2004/0144344 A1 Jul. 29, 2004

(30) Foreign Application Priority Data

Jan. 14, 2003 (JP) ..... 2003-006184
Mar. 20, 2003 (JP) ..... 2003-076777

(51) Int. Cl.
*F02B 75/02* (2006.01)

(52) U.S. Cl. ..... 123/317; 123/311

(58) Field of Classification Search ..... 123/317, 123/311

See application file for complete search history.

(56) References Cited

U.S. PATENT DOCUMENTS 6,659,064 B1 * 12/2003 Massmann et al. ..... 123/196 R

FOREIGN PATENT DOCUMENTS

| | | |
|---|---|---|
| JP | 04-093707 U | 3/1992 |
| JP | 04-113711 | 10/1992 |
| JP | 06-299830 | 10/1994 |
| JP | 06-346718 | 12/1994 |
| JP | 08-100621 A | 4/1996 |
| JP | 10-246115 | 9/1998 |
| JP | 2001-152981 | 6/2001 |

* cited by examiner

*Primary Examiner*—Tony M. Argenbright
*Assistant Examiner*—Katrina Harris

(57) ABSTRACT

To provide a four-cycle combustion engine wherein the air-fuel mixture can be smoothly passed at all times by the utilization of the reciprocating motion of the piston to effectively lubricate the valve operating mechanism and the cranking mechanism and also to allow the air-fuel mixture to be supplied into the combustion chamber with a high suction efficiency. By utilization of the reciprocating motion of the piston (9), a portion of the air-fuel mixture (M) fed from the intake passage (33) is circulated through a circulating passage made up of the valve chamber (18), the first passage (24), the crankcase chamber (7) and the second passage (41).

11 Claims, 12 Drawing Sheets

FOUR-CYCLE INTERNAL COMBUSTION ENGINE

BACKGROUND OF THE INVENTION

1. Field of the Invention

The present invention generally relates to a four-cycle internal combustion engine and, more particularly, to the four-cycle internal combustion engine for use as a power plant in a small size, portable working machine such as, for example, a bush cutter and a mowing machine.

2. Description of the Related Art

It is generally known that the small size, portable working machine such as, for example, a bush cutter is operated adaptively in all positions considered suitable, necessary, optimal and/or convenient for the operator to perform an intended work. Accordingly, the small size, portable working machine has long employed a two-cycle combustion engine of a type utilizing an oil-mixed fuel, i.e., a mixture of fuel with oil. However, in recent years, in view of the pressing demand to substantially purify exhaust gases emitted from the working machine, a four-cycle combustion engine capable of being used as a power plant in the small size, portable working machine has come to be developed such as disclosed in, for example, the Japanese Laid-open Utility Model Publication No. 4-93707.

The four-cycle combustion engine suggested in the above mentioned publication includes an oil sump disposed at the bottom of the crankcase, the design of which is specifically tailored to prevent lubricant oil, accumulated within the oil sump, from leaking even when the portable working machine is operated in any position inclined within a predetermined angle. However, with this four-cycle combustion engine, it has been found that since the lubricant oil within the oil sump tends to flow into a combustion chamber particularly when the portable working machine is so inclined as to assume a substantially inverted (i.e., upside down) position, such portable working machine is in effect incapable of being used in all positions. Also, considering that a substantially large amount of lubricant oil is accommodated within the oil sump, the portable working machine as a whole tends to be so heavy as to impose an increased amount of labor on the operator.

On the other hand, the four-cycle combustion engine requiring no oil sump and capable of being used in all positions is suggested and disclosed in, for example, the Japanese Laid-open Patent Publication no. 8-100621. With the four-cycle combustion engine disclosed in this second mentioned publication, an air-fuel mixture containing oil similar to that used in the two-cycle combustion engine is utilized and is introduced into the crankcase. The air-fuel mixture within the crankcase is, by the utilization of change in pressure inside the crankcase that occurs as a result of a reciprocating motion of the piston, allowed to flow through a first air-fuel passage communicated directly with an intake port as well as through a second air-fuel passage communicated with the intake port through a valve operating mechanism, into the combustion chamber through the intake port, so that a lubricant oil contained in the air-fuel mixture can be utilized to lubricate various parts within the crankcase and those of the valve operating mechanism.

In the four-cycle combustion engine that can be used in all positions such as disclosed in the second mentioned publication, during the intake stroke the air-fuel mixture containing oil within the crankcase that is compressed as a result of a descending motion of the piston is supplied to the intake port through the first air-fuel passage. On the other hand, the air-fuel mixture is also supplied through the second air-fuel passage into a valve chamber of the valve operating mechanism and a portion of the air-fuel mixture introduced into the valve chamber is subsequently introduced into the intake port through a small opening defined in the bottom of the valve chamber and defining a part of the breathing passage. At this time, the lubricant oil then pooled within the valve chamber flows outwardly from the valve operating mechanism through the opening at the bottom of the valve chamber and into the combustion chamber through the intake port. This results in white fume generated undesirably.

Also, in the four-cycle combustion engine disclosed in the second mentioned publication, since the opening at the bottom of the valving chamber is too small for the air-fuel mixture to flow smoothly within the valve chamber, the lubricant oil contained in the air-fuel mixture tends to stick to wall surfaces of passages where the air-fuel mixture flows little and, therefore, various parts of the engine will hardly be lubricated effectively.

SUMMARY OF THE INVENTION

The present invention has therefore been devised to substantially eliminate the problems and inconveniences inherent in the prior art four-cycle combustion engines discussed above and is intended to provide an improved four-cycle combustion engine of a type wherein the air-fuel mixture can be smoothly passed by the utilization of the reciprocating motion of the piston to effectively lubricate the valve operating mechanism and the cranking mechanism.

In order to accomplish the foregoing object, the present invention provides a four-cycle combustion engine which includes a valve operating mechanism having a valve drive unit mounted on a cylinder head for driving intake and exhaust valves, and a drive transmitting unit for transmitting a rotary drive of a crankshaft, drivingly coupled with a piston, to the valve drive unit. The valve drive unit is accommodated in a valve chamber that is communicated with an intake port of the engine capable of being selectively opened or closed by the intake valve. An air-fuel mixture containing lubricant oil is introduced into the valve chamber through an intake passage. The drive transmitting unit is accommodated in a first passage that is communicated between the valve chamber and a crankcase chamber. A second passage is defined so as to communicate between the crankcase chamber and the valve chamber. With the four-cycle combustion engine so constructed, the valve chamber, the first passage, the crankcase chamber and the second passage cooperate with each other to define a circulating passage through which a portion of the air-fuel mixture from the intake passage is circulated as a result of a reciprocating motion of the piston.

According to the present invention, while of the air-fuel mixture containing the lubricant oil introduced from the intake passage into the valve chamber and the intake port is sucked in a combustion chamber during an intake stroke of the engine, a portion of the air-fuel mixture is circulated through the circulating passage in unison with change in pressure inside the crankcase chamber that is brought about by the reciprocating motion of the piston. Accordingly, the lubricant oil contained in the air-fuel mixture then being circulated through the circulating passage is utilized to effectively lubricate the valve operating mechanism including the valve drive unit within the valve chamber and the drive transmitting unit within the first passage and the various parts within the crankcase chamber. Accordingly, the four-cycle combustion engine of the present invention requires no oil sump such as hitherto required, not only making it possible for the combustion engine not only to be manufactured compact and lightweight, but also to be operated in all positions in a stable manner.

Because of the foregoing, the air-fuel mixture smoothly flows in the circulating passage without stagnating and, therefore, the lubricant oil will not stagnate within the valve chamber having a relatively large capacity. Also, the air-fuel mixture produced by the air-fuel mixture producing device such as, for example, a carburetor is introduced directly into the valve chamber and the intake port through the intake passage and the valve chamber has a relatively large capacity. Accordingly, even though a portion of the air-fuel mixture so introduced is used for lubrication purpose, little variation of the internal pressure in the valve chamber occurs and, therefore, it will not lead to reduction in efficiency of suction of the air-fuel mixture into the combustion chamber.

In a preferred embodiment, a check valve for controlling a direction of flow of the air-fuel mixture within the circulating passage may be employed. The use of the check valve makes it possible to feed under pressure and circulate the air-fuel mixture in one direction through the circulating passage forcibly by the effect of a change in pressure inside the crankcase chamber and selective opening and closing of the check valve, both of which take place in unison with the reciprocating motion of the piston within a cylinder bore and, therefore, the air-fuel mixture can smoothly flow within the circulating passage.

The valve chamber is preferably defined by a rocker cover mounted atop the cylinder head and further comprising an air-fuel mixture producing device disposed in the intake passage and arranged at a location laterally of the rocker cover. Since a large space is available at a location laterally of the rocker cover, an advantage can be appreciated in terms of availability of space for installation.

In another preferred embodiment, the air-fuel mixture circulates in the circulating passage in one direction from the valve chamber back to the valve chamber through the first passage, then through the crankcase chamber and finally through the second chamber. This can bring about a high effect of cooling the valve operating mechanism since the fresh air-fuel mixture as supplied from the intake passage into the valve chamber acts to cool the valve operating mechanism including the valve drive unit within the valve chamber and the drive transmitting unit within the first passage.

Also, the four-cycle combustion engine of the present invention preferably includes at least one of a first check valve disposed at a junction between the first passage and the crankcase chamber for allowing a flow of the air-fuel mixture only in one direction from the first passage towards the crankcase chamber, and a second check valve disposed at a junction between the second passage and the crankcase chamber for allowing a flow of the air-fuel mixture only in one direction from the crankcase chamber towards the second passage.

According to this structural feature, during the intake stroke and the power or expansion stroke, in response to increase of the pressure inside the crankcase chamber resulting from the descending motion of the piston the first check valve is closed and the second check valve is opened, allowing the air-fuel mixture within the crankcase chamber to be fed under pressure towards the valve chamber through the second passage. During the compression stroke and the exhaust stroke, however, the second check valve is closed and the first check valve is opened when a negative pressure is developed within the crankcase chamber as a result of the ascending motion of the piston, with the air-fuel mixture within the valve chamber consequently flowing into the crankcase chamber through the first passage. Accordingly, the provision of at least one of the first and second check valve is effective to allow the air-fuel mixture in the circulating passage to be smoothly and effectively fed under pressure from the valve chamber back to the valve chamber through the first passage, the crankcase chamber and the second passage.

Alternatively, the above mentioned air-fuel mixture may circulate in the circulating passage in one direction, which is reverse to the direction in the above-mentioned another preferred embodiment, from the valve chamber back to the valve chamber through the second passage, then through the crankcase chamber and finally through the first passage. Even with this structure, not only can the valve operating mechanism and the various parts within the crankcase chamber effectively be lubricated by the lubricant oil contained in the air-fuel mixture, but also the reduction of efficiency in suction of the air-fuel mixture into the combustion chamber can be avoided.

In this structure there may be employed at least one of a first check valve disposed at a junction between the second passage and the crankcase chamber for allowing a flow of the air-fuel mixture only in one direction from the second passage towards the crankcase chamber, and a second check valve disposed at a junction between the first passage and the crankcase chamber for allowing a flow of the air-fuel mixture only in one direction from the crankcase chamber towards the first passage, may be employed.

According to this structural feature, during the intake stroke and the power or expansion stroke, in response to increase of the pressure inside the crankcase chamber resulting from the descending motion of the piston the first check valve is closed and the second check valve is opened, allowing the air-fuel mixture within the crankcase chamber to be fed under pressure towards the valve chamber through the first passage. During the compression stroke and the exhaust stroke, however, the first check valve is opened and the second check valve is closed when a negative pressure is developed within the crankcase chamber as a result of the ascending motion of the piston, with the air-fuel mixture within the valve chamber consequently flowing into the crankcase chamber through the second passage. Accordingly, the provision of at least one of the first and second check valve is effective to allow the air-fuel mixture in the circulating passage to be smoothly and effectively fed under pressure from the valve chamber back to the valve chamber through the second passage, the crankcase chamber and the first passage.

In such case, the second passage is preferably fluid connected between the crankcase chamber and a portion of the valve chamber opposite to or remote from an intake mouth opening to the valve chamber for introducing the air-fuel mixture. Disposition of the second passage at a location between the crankcase chamber and that portion of the valve chamber remote from the intake port can permit the air-fuel mixture within the valve chamber to flow in a direction counter to the intake passage and then into the second passage and, accordingly, the air-fuel mixture will not reverse flow into the intake passage, resulting in elimination of the use of the check valve in the intake passage, with the combustion engine consequently simplified in structure.

In a still further preferred embodiment, a cylinder block may have an inlet port defined therein in communication with the crankcase chamber and capable of being selectively opened or closed by the piston reciprocatingly moving within the cylinder block. In such case, the second passage is fluid connected between the valve chamber and the inlet port, so that the air-fuel mixture can circulate in the circulating passage in one direction from the valve chamber back to the valve chamber through the second passage, then through the crankcase chamber and finally through the first passage.

According to this structural feature, the air-fuel mixture introduced into the valve chamber and the intake port through the intake passage during the intake stroke can, when the inlet port in the cylinder block is opened as a result of the ascending motion of the piston during the subsequent compression stroke, flows from the valve chamber into the crankcase chamber through the second passage by way of the inlet port. The air-fuel mixture within the crankcase chamber can be fed to the valve chamber through the first passage when the inlet port is closed by the piston then descending during the power or expansion stroke, accompanied by increase of the pressure inside the crankcase chamber. Thus, by the utilization of the valving action of the piston, the air-fuel mixture can be smoothly supplied in a direction from the second passage towards the crankcase chamber.

In this structure, a check valve may be disposed at a junction between the first passage and the crankcase chamber for allowing a flow of the air-fuel mixture from the crankcase chamber towards the first passage, so that the air-fuel mixture within the circulating passage can effectively be prevented from flowing in the reverse direction.

Yet, the second passage is preferably fluid connected between the crankcase chamber and a portion of the valve chamber opposite to or remote from an intake mouth opening to the valve chamber for the air-fuel mixture.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

With reference to the accompanying drawings, some preferred embodiments of the present invention will be described in detail.

Figure 1:
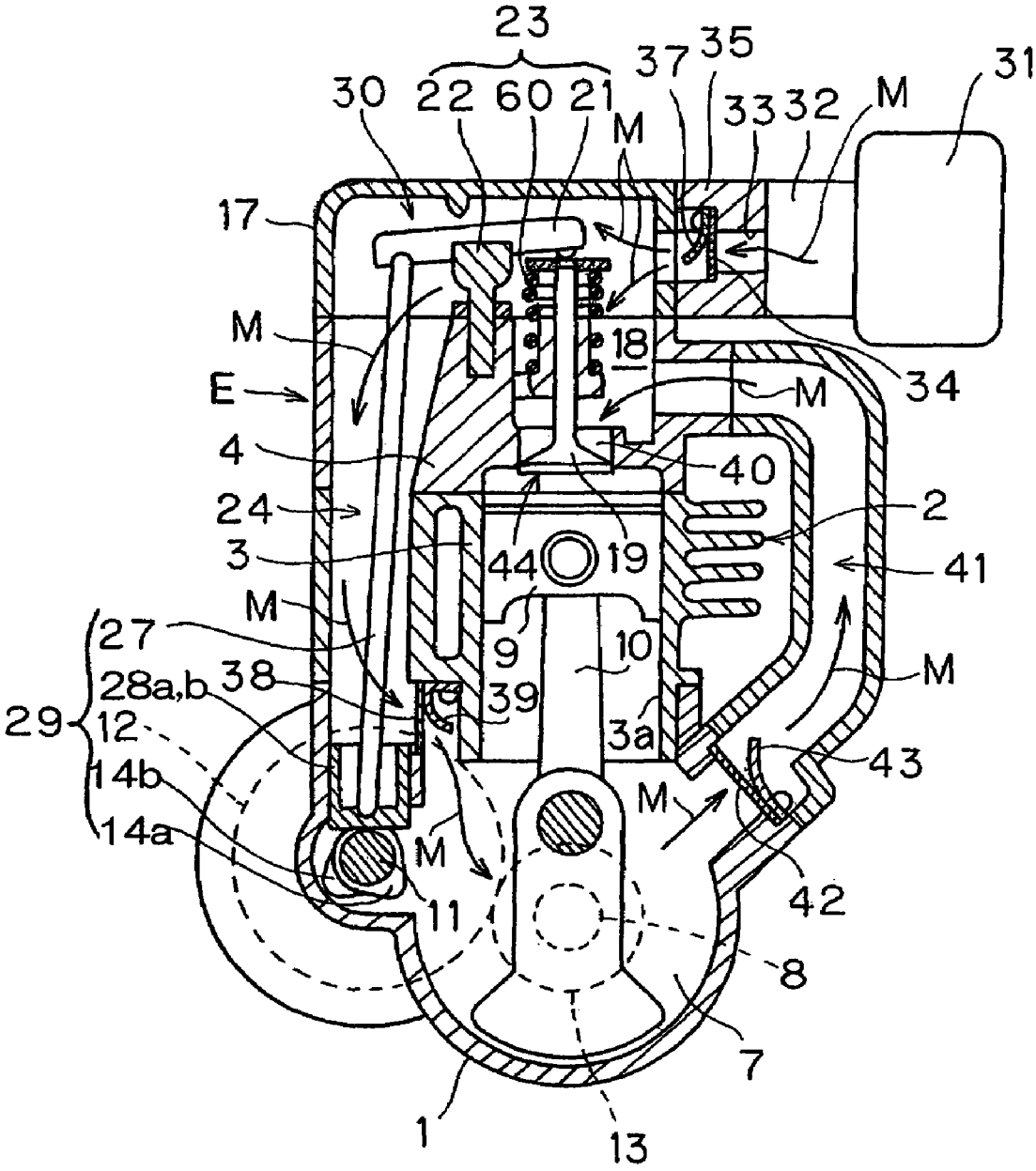
FIG. 1 is a schematic transverse sectional view showing the principle of a four-cycle combustion engine according to a first preferred embodiment of the present invention.

Referring first to FIG. 1, there is shown a transverse sectional view of an overhead valve type four-cycle internal combustion engine, shown for the purpose of explaining the principle thereof according to a first embodiment of the present invention. The four-cycle internal combustion engine includes an engine body E made up of a crankcase 1, a cylinder block 2 and fixedly mounted atop the crankcase 1 and having at least one cylinder 3 defined therein, and a cylinder head 4 fixedly mounted atop the cylinder block 2. A crankshaft 8 is rotatably supported by means of journals (not shown) within a crankcase chamber 7 defined in the crankcase 1, and a reciprocating piston 9 reciprocatingly movable within a cylinder bore 3*a* is drivingly coupled with the crankshaft 8 through a corresponding connecting rod 10.

The crankcase chamber 7 also accommodate therein a cam shaft 11 supported by journals (not shown) for rotation about its own longitudinal axis and has a driven gear 12 fixedly mounted on one end thereof for rotation together therewith. The driven gear 12 is meshed at all times with a drive gear 13 fixedly mounted on the crankshaft 8 for rotation together therewith. A intake control cam 14*a* for selectively opening and closing an intake valve and an exhaust control cam 14*b* for selectively opening and closing an exhaust valve are also fixedly mounted on the cam shaft 11. Intake and exhaust valve mechanism will be described in more detail later.

A rocker cover 17 is mounted atop the cylinder head 4 and cooperate therewith to define a valve chamber 18 therebetween. The intake valve 19 and the exhaust valve (not shown) are mounted on the cylinder head 4 with their respective stems operatively protruding into the valve chamber 18. The valve chamber 18 accommodates therein a valve drive unit 23 including respective compression springs 60 for normally urging the intake valve 19 and the exhaust valve towards an closed position, respective rocker arms 21 for driving the intake valve 19 and the exhaust valve to selectively open and close an intake port and an exhaust port, and a support member 22 fixed on the cylinder head 4 for supporting those two rocker arms 21 so as to allow the latter to undergo a rocking motion.

An air-fuel mixture producing device 32 such as a carburetor for mixing a mixed fuel, containing fuel and lubricant oil, with air introduced from an air cleaner 31 to thereby produce an air-fuel mixture M containing the lubricant oil is fluid connected with the valve chamber 18 through a heat insulator 35 and, therefore, the air-fuel mixture M containing the lubricant oil can be introduced into the valve chamber 18 through an intake passage 33 defined so as to extend through the air-fuel mixture producing device 32 and the heat insulator 35. A junction between the intake passage 33 and the valve chamber 18 is provided with a intake check valve 34 for preventing back flow of the air-fuel mixture M from the valve chamber 18 into the intake passage 33 and a valve stopper 37 for regulating the maximum opening of the intake check valve 34.

The engine body E includes a drive transmitting passage (first passage) 24 formed laterally of the cylinder bore 3*a* so as to communicate between the crankcase chamber 7 and the valve chamber 18. Specifically, the drive transmitting passage 24 so formed extends in part in the crankcase 1, in part in the cylinder block 2 and also in part in the cylinder head 4 to thereby fluid connect the crankcase chamber 7 with the valving chamber 18 and accommodates therein a drive transmitting unit 29 for transmitting a rotary drive of the crankshaft 8 to the valve drive unit 23. This passage 24 also accommodates therein respective push rods 27 each having an upper end engaged with the corresponding rocker arm 21 and cam followers 28*a*, 28*b* each supporting a lower end of the associated push rod 27. The cam followers 28*a*, 28*b* are engageable with the fuel intake control cam 14*a* or the exhaust control cam 14*b*, respectively.

The push rods 27 and the cam followers 28*a*, 28*b* form respective parts of the drive transmitting unit 29 together with the drive gear 13, the driven gear 12, the intake control cam 14*a* and the exhaust control cam 14*b*. In other words, the drive transmitting unit 29 is so designed that the rotary drive of the crankshaft 8 can be transmitted to the rocker arms 21 of the valve drive unit 23 through the drive gear 13, the driven gear 12, the fuel intake control cam 14*a* and the exhaust control cam 14*b*. Accordingly, the valve drive unit 23 and the drive transmitting unit 29 altogether constitute a valve operating mechanism 30 of the overhead valve (OHV) system. Also, a junction of the drive transmitting passage 24 to the crankcase chamber 27 is provided with a first check valve 38 operable to allow only the flow of the air-fuel mixture M from the valve chamber 18 to the crankcase chamber 7 through the drive transmitting passage 24 and a valve stopper 39 for regulating the maximum opening of the first check valve 38.

An intake port 40 and an exhaust port (not shown) controlled to be closed/opened respectively by the intake valve 19 and the exhaust valve (not shown) are defined in the cylinder head 4, with the intake port 40 communicated with the valve chamber 18. The crankcase chamber 7 and the valve chamber 18 are communicated with each other by means of an auxiliary passage (second passage) 41, and a junction of the auxiliary passage 41 to the crankcase chamber 7 is provided with a second check valve 42 operable to allow only the flow of the air-fuel mixture M from the crankcase chamber 7 towards the valve chamber 18 through the auxiliary passage 41 and a valve stopper 43 for regulating the maximum opening of the second check valve 42.

The operation of the four-cycle internal combustion chamber of the structure described above will now be described.

During the intake stroke in which the piston 9 descends with the intake valve 19 then opened, the air-fuel mixture M containing the lubricant oil is introduced into a combustion chamber 44 through the intake port 40 opened by the intake valve 19 and the intake check valve 34 is opened to allow a fresh air-fuel mixture M to be introduced from the air-fuel mixture producing device 32 into the valve chamber 18 and the intake port 40, communicated with the valve chamber 18, through the intake passage 33. The air-fuel mixture M introduced into the combustion chamber 44 is subsequently compressed during the compression stroke by the piston 9 then ascending within the cylinder bore 3*a*. On the other hand, since a negative pressure is developed within the crankcase chamber 7 as the piston 9 ascends, the first check valve 38 is opened to allow a portion of the air-fuel mixture M within the valve chamber 18 to flow into the crankcase chamber 7 through the drive transmitting passage 24.

During the subsequent power or expansion stroke in which the air-fuel mixture then compressed within the combustion chamber 44 is ignited to expands, the first check valve 38 and the second check valve 42 are brought to closed and opened positions, respectively, in response to increase of the pressure inside the crankcase chamber 7 resulting from the descending motion of the piston 9. Accordingly, the air-fuel mixture M within the crankcase chamber 7 is fed under pressure towards the intake port 40 and the valve chamber 18 through the auxiliary passage 41 to admix with the air-fuel mixture M fed from the air-fuel mixture producing device 32 through the intake passage 33.

During the exhaust stroke that follows the power stroke, the piston 9 ascends with the exhaust valve then opened and, accordingly, combustion gases within the combustion chamber 44 are discharged as exhaust gases to the atmosphere through the exhaust port. At this time, a negative pressure is developed within the crankcase chamber 7 as a result of the ascending motion of the piston 9, with the first check valve 38 consequently brought to an opened position, allowing a portion of the air-fuel mixture M within the valve chamber 18 to flow into the crankcase chamber 7 through the drive transmitting passage 24. During the subsequent intake stroke following the exhaust stroke, as the piston 9 descends, the air-fuel mixture M within the crankcase chamber 7 flows into the auxiliary passage 41 through the second check valve 42 and then into the valve chamber 18 through the auxiliary passage 41, with that portion of the air-fuel mixture M within the valve chamber 18 consequently introduced into the combustion chamber 44 through the intake port 40 as hereinabove described.

Thus, in the four-cycle internal combustion engine discussed above, a portion of the air-fuel mixture M introduced from the air-fuel mixture producing device 32 to the valve chamber 18 and the intake port 40 can be sucked into the combustion chamber 44 when the intake valve 19 is opened, and another portion of the air-fuel mixture M can be circulated in one direction (forward direction) at all times through a circulating passage, extending from the valve chamber 18 back to the valve chamber 18 through the drive transmitting passage 24, then through the crankcase chamber 7 and finally through the auxiliary passage 41, by the effect of the reciprocating motion of the piston 9 within the cylinder bore 3*a*. Accordingly, since the air-fuel mixture M being circulated flows smoothly without stagnating within the circulating passage, the lubricant oil contained in the air-fuel mixture M will not substantially stagnate within the valve chamber 18 that is of a relatively large capacity. Even if the lubricant oil stagnates within the valve chamber 18, this lubricant oil can be purged into the crankcase chamber 7 by the air-fuel mixture M then fed under pressure in the forward direction by way of the first and second check valves 38 and 42, controlled in the manner described above, during the reciprocating motion of the piston 9 and, therefore, it will not constitute a cause of white fume which would otherwise be produced when the lubricant oil stagnating within the valve chamber 18 will directly enter the combustion chamber 44 through the intake port 40.

As discussed above, the lubricant oil contained in the air-fuel mixture M being circulated through the circulating passage is effectively utilized to lubricate the valve operating mechanism 30 including the drive mechanism 23 within the valve chamber 18 and the drive transmitting unit 29 within the drive transmitting passage 24, and the various parts within the crankcase chamber 7. Accordingly, the necessity of the oil sump is eliminated, not only making it possible for the four-cycle internal combustion engine to be manufactured compact and light-weight, but also allowing such combustion engine to be operated stably in any desired position. It is thus clear that the four-cycle internal combustion engine discussed above with particular reference to FIG. 1 can be used and operated in all positions.

Also, not only because the air-fuel mixture M from the air-fuel mixture producing device 32 is supplied directly to the valve chamber 18 and the intake port 40 solely through the intake passage 33 that is of a relatively small length, but also because the valve chamber 18 has a relatively large capacity, even the use of a portion of the supplied air-fuel mixture M for lubrication purpose does not result in variation of the internal pressure in the valve chamber 18. In addition, the air-fuel mixture M as supplied from the air-fuel mixture producing device 32 and the air-fuel mixture M having been utilized to lubricate the various parts within the crankcase chamber 7 admix together within the valve chamber 18, thereby increasing the amount of the air-fuel mixture M to be subsequently supplied to the intake port 40 and, accordingly, the supply of the air-fuel mixture M is in effect stabilized without the intake efficiency of the air-fuel mixture being lowered. Yet, since the fresh air-fuel mixture M as supplied from the air-fuel mixture producing device 32 to the valve chamber 18 serves to cool the valve operating mechanism 30 prior to being introduced into the crankcase chamber 7, it is clear that the valve operating mechanism 30 can be highly positively cooled.

Figure 2:
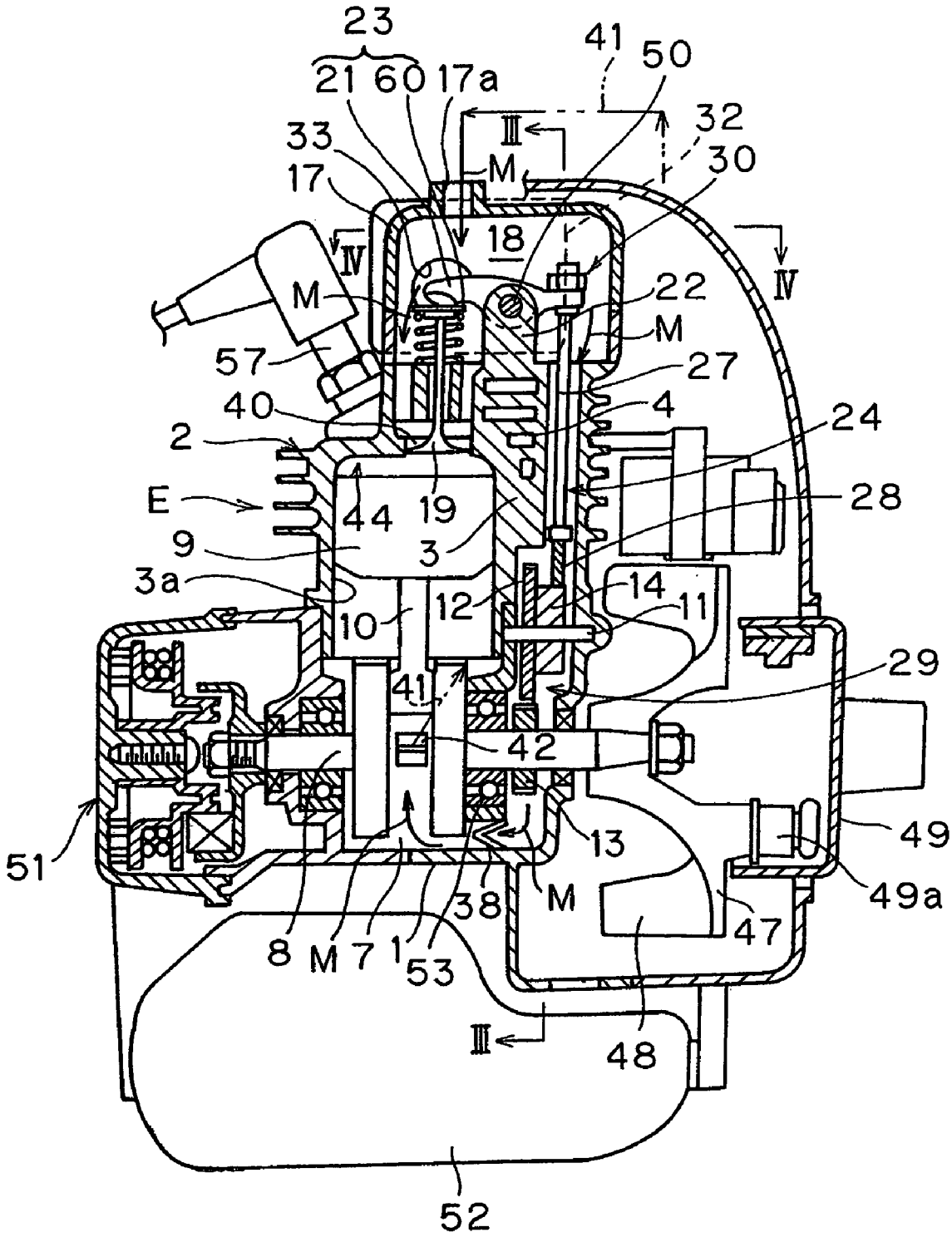
FIG. 2 is a longitudinal sectional view of the four-cycle combustion engine according to the first preferred embodiment of the present invention.

FIG. 2 illustrates a specific example as applied to a bush cutter, in which the four-cycle internal combustion engine according to the first embodiment of the present invention and based on the principle discussed with particular reference to FIG. 1 is employed.

Referring now to FIG. 2, the crankshaft 8 has one end, a left end so far shown, provided with a recoil stator 51 of the combustion engine, whereas a cooling fan 47 concurrently serving as a flywheel is fixedly mounted on the opposite end, that is, the right end of the crankshaft 8. The cooling fan 47 has an axially inner surface formed with a plurality of cooling fins 48 and an axially outer surface fitted with a clutch shoe 49*a* of a clutch 49. The crankshaft 8 is drivingly coupled with a drive transmitting shaft (not shown) of the bush cutter through the clutch 49. One end of the drive transmitting shaft of the bush cutter remote from the clutch 49 is utilized to rotate a cutter assembly (not shown). A fuel tank 52 is connected to the bottom of the crankcase 1. The mixed fuel, i.e., the fuel mixed beforehand with the lubricant oil, within the fuel tank 52 is supplied to the previously discussed air-fuel mixture producing device 32 through a fuel supply pipe (not shown). As a matter of design, an ignition plug 57 is mounted on the cylinder head 4 at a predetermined location sufficient to ignite the air-fuel mixture M within the combustion chamber 44.

The drive transmitting passage 24 extending between the valve chamber 18 and the crankcase chamber 7 is positioned generally intermediate between the cylinder bore 3*a* and the cooling fan 48 and accommodates therein the drive gear 13, the driven gear 12, a single control cam 14 including the fuel intake control cam 14*a* and the exhaust control cam 14*b* (FIG. 1), a single cam follower 28 including a pair of the cam followers 28*a*, 28*b* (FIG. 1) and the push rods 27. While the second check valve 42 at the lower end of the auxiliary passage 41 is positioned at a level higher than the first check valve 38, the air-fuel mixture M sucked into the bottom of the crankcase chamber 7 through the first check valve 38 can be shoveled upwardly by the rotating crankshaft 8 as the piston 9 ascends and descends, respectively, to thereby lubricate the various parts within the crankcase chamber 7. At the same time, the air-fuel mixture M within the crankcase chamber 7 is smoothly discharged from the crankcase chamber 7 through the second check valve 42 then opened as a result of such shoveling function and increase of the pressure inside the crankcase chamber 7.

Figure 3:
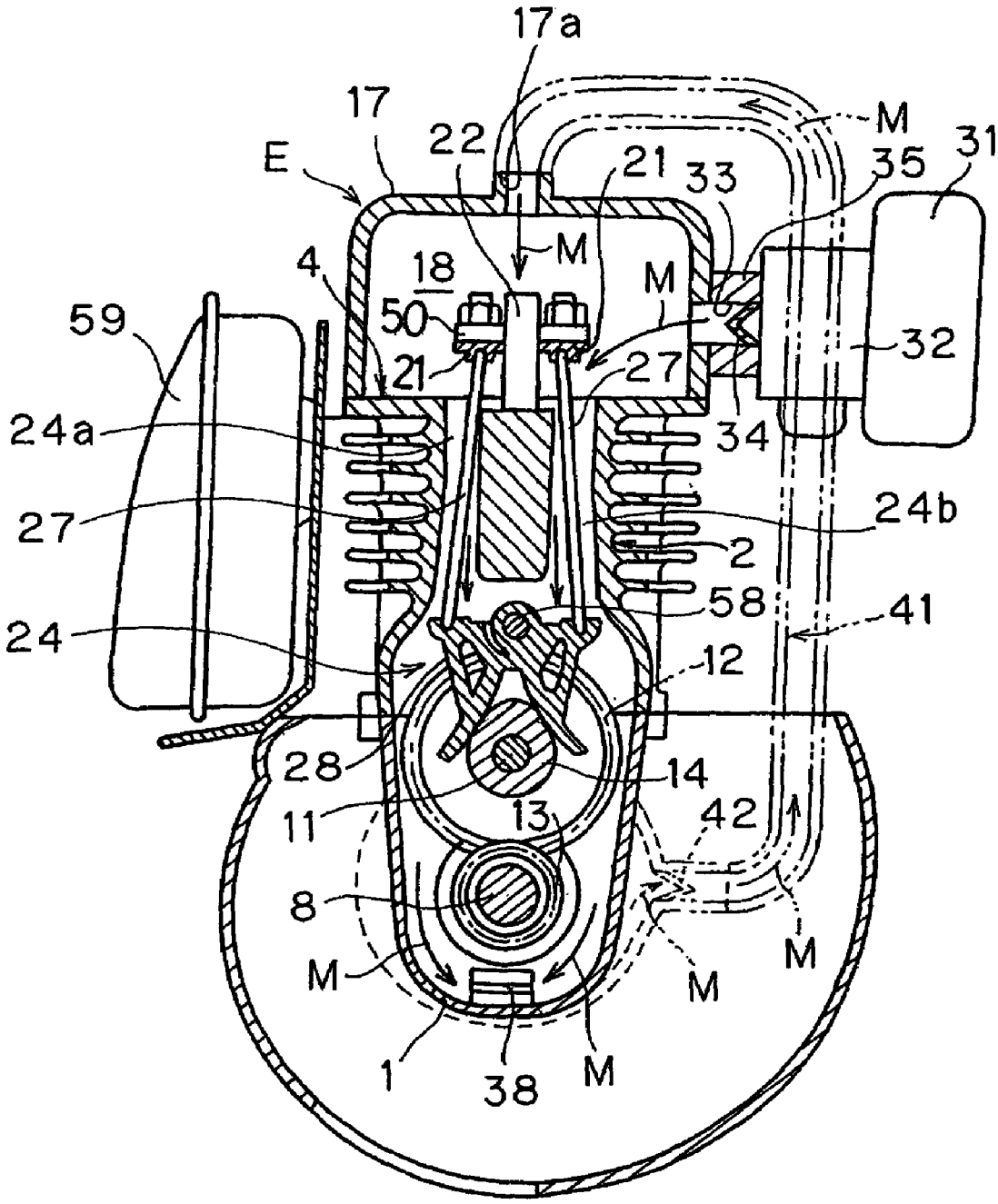
FIG. 3 is a cross-sectional view taken along the line III—III in FIG. 2.
Figure 4:
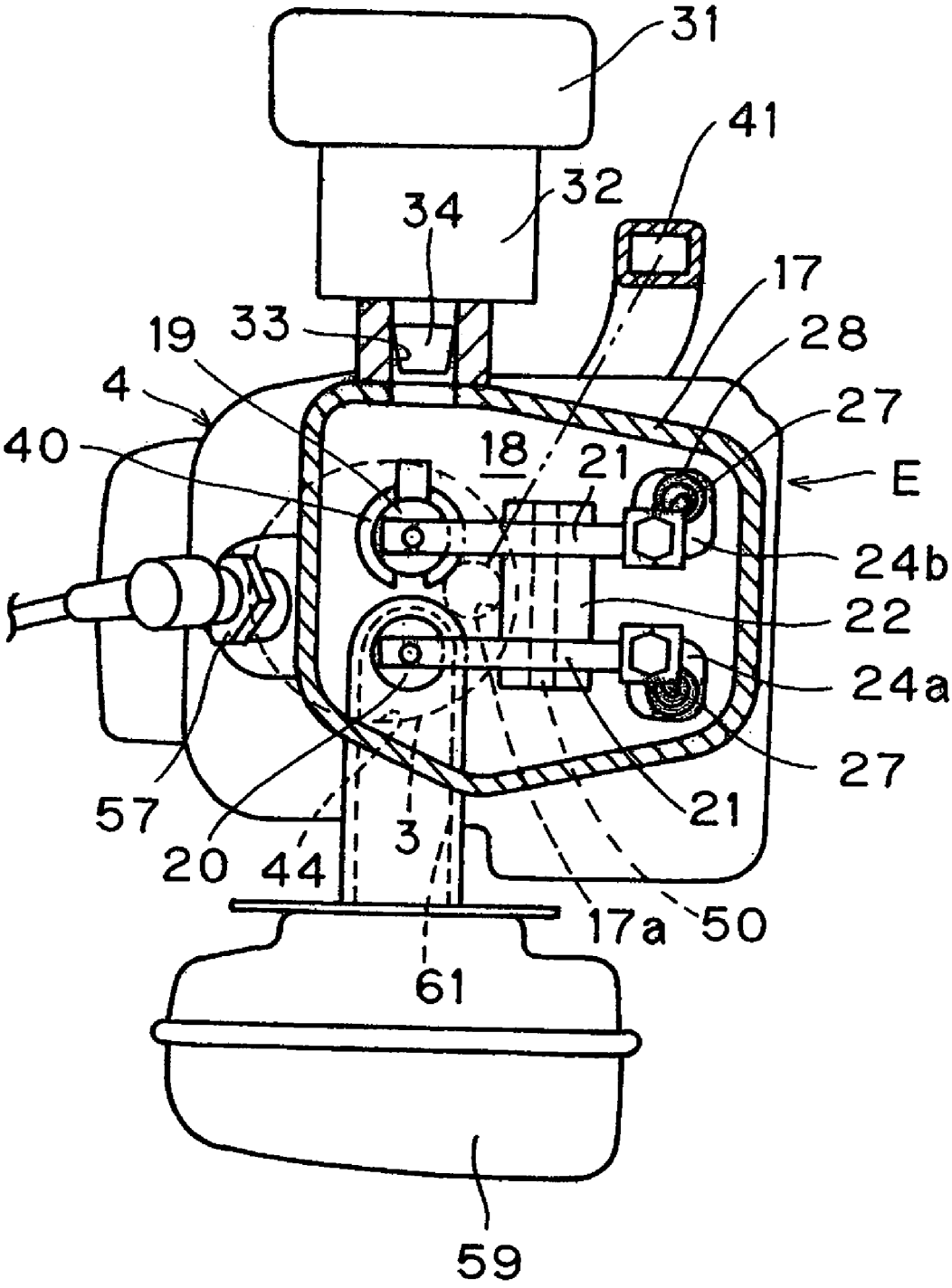
FIG. 4 is a cross-sectional view taken along the line VI—VI in FIG. 2.

Referring to FIGS. 3 and 4 showing cross-sectional views of the four-cycle internal combustion engine taken along the lines III—Ill and VI—VI in FIG. 2, respectively, the support member 22 secured to the cylinder head 4 as shown in FIG. 3 supports the rocker arms 21, operatively associated respectively with the fuel intake valve 19 and the exhaust valve 20 shown in FIG. 4, so as to enable the rocker arms 21 to undergo a rocking motion about a common support pin 50. With the rocker arms 21 rockingly supported as described above, each of those rocker arms 21 is drivingly associated with one end of the cam follower 28 shown in FIG. 3 by means of the corresponding push rod 27. The two push rods 27 extend freely movably within corresponding portioned canals 24*a* and 24*b* defined in the drive transmitting passage 24.

Accordingly, it is clear that the air-fuel mixture M within the valve chamber 18 can flow through the partitioned canals 24*a* and 24*b* to lubricate the cam follower 28, the cam 14 and the drive gear 13 and can, when the first check valve 38 is opened, flow from the bottom of the crankcase chamber 7 into the auxiliary passage 41 that is communicated with the valve chamber 18 through a connection port 17*a* defined in a top wall of the rocker cover 17.

The air-fuel mixture producing device 32 and the air cleaner 31, cooperating with each other to form an air-fuel mixture intake system of the combustion engine, is arranged on one side of the cylinder head 4 so that the air-fuel mixture M can be supplied directly into the valve chamber 18 positioned in an upper region of the engine body E. On the other hand, a muffler 59 forming a part of the engine exhaust system is arranged on the opposite side of the cylinder head 4.

In the conventional four-cycle internal combustion engine of a similar kind, the air-fuel mixture intake system is generally arranged in the vicinity of the fuel tank 52 shown in FIG. 2 so that the air-fuel mixture can be supplied to the crankcase chamber. In contrast thereto, the four-cycle internal combustion engine embodying the present invention is such that the air-fuel mixture producing device 32 and the air cleaner 31 are both mounted atop the engine body E, e.g., on a side portion of the rocker cover 17 or at a location laterally thereof so far shown, where a relatively large space is advantageously available. In addition, the connection port 17*a* for fluid connection with the auxiliary passage 41 is defined in the top wall of the rocker cover 17 and this disposition of the connection port 17*a* should provide a relatively large freedom of the engine air intake system being disposed in any desired manner. Specifically, in the illustrated embodiment as best shown in FIG. 4, the auxiliary passage 41 is disposed on one side of the engine body E and in the vicinity of the air-fuel mixture producing device 32.

Referring still to FIG. 4, the intake valve 19 is selectively opened or closed by one of the rocker arms 21 that is shown in an upper portion of the drawing of FIG. 4 whereas the exhaust valve 20 is selectively opened or closed by the other of the rocker arms 21 that is shown in a lower portion of the drawing of FIG. 4. When the exhaust valve 20 is opened, combustion gases produced within the combustion chamber 44 (FIG. 2) during the power stroke can be discharged as exhaust gases during the exhaust stroke to the atmosphere through the exhaust passage 61 by way of the muffler 59.

Although the cylinder head 4 having the intake and exhaust valves 19 and 20 operatively mounted thereon may be heated to a relatively high temperature by the effect of the combustion gases, the cylinder head 4 can be effectively and efficiently cooled by the fresh air-fuel mixture M shown in FIG. 3 as introduced directly from the air-fuel mixture producing device 32 into the valve chamber 18 and the air-fuel mixture M circulated back into the valve chamber 18 through the circulating passage including the auxiliary passage 41.

It is pointed out that in the conventional internal combustion engine of a similar kind, for effectively cooling the cylinder head apt to be heated to a high temperature various attempts have been made to form one or more cooling air holes of a small diameter on the cylinder head. However, since the four-cycle internal combustion engine of a small size specifically intended for use in a bush cutter cannot afford such a cooling means in terms of the space available, an effective cylinder head cooling has not yet been attained. In contrast thereto, in the four-cycle internal combustion engine embodying the present invention, the air-fuel mixture M is effectively utilized to cool the cylinder head 4 efficiently.

In the practice of the foregoing embodiment of the present invention, either one of the first and second check valves 38 and 42 may be dispensed with if so desired. The use of only one check valve can advantageously result in reduction in number of the component parts used, facilitating simplification in structure of the combustion engine as a whole and, hence, the combustion engine of the present invention can be easily manufactured compact and lightweight.

Figure 5:
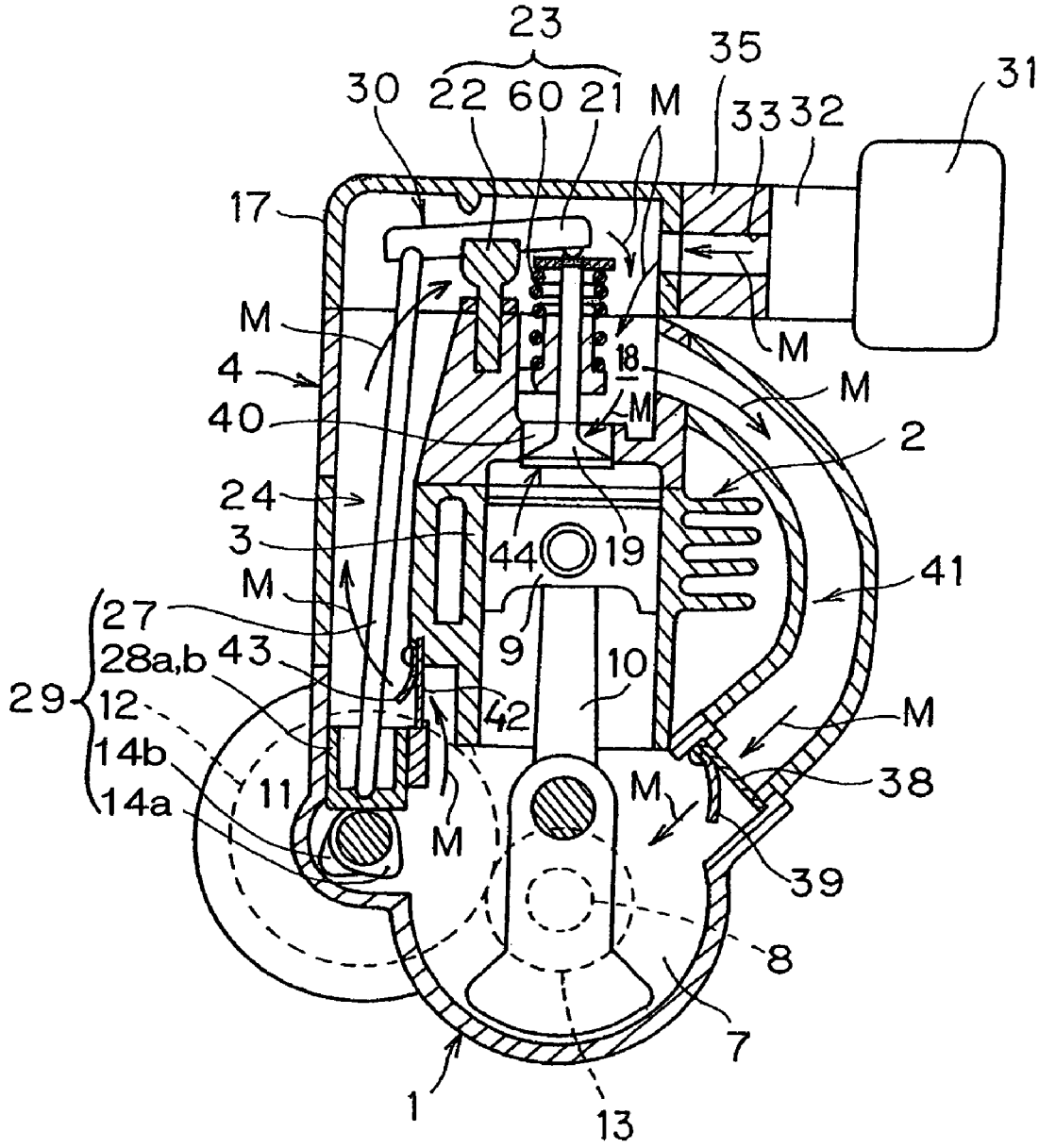
FIG. 5 is a schematic transverse sectional view showing the principle of a four-cycle combustion engine according to a second preferred embodiment of the present invention.

Referring to FIG. 5, the four-cycle internal combustion engine according to a second preferred embodiment of the present invention will be described. It is, however, to be noted that like parts shown in FIG. 5, but similar to those shown in FIG. 1 are designated by like reference numerals and, therefore, the details thereof are not reiterated for the sake of brevity.

The four-cycle internal combustion engine shown in FIG. 5 differs from that shown in FIG. 1 in respect of the positions of the first and second check valves. Specifically, as shown in FIG. 5, the first check valve 38 for allowing only the flow of the air-fuel mixture M from the valve chamber 18 towards the crankcase chamber 7 is disposed within the auxiliary passage (second passage) 41 and at the junction between it and the crankcase chamber 7 and the second check valve 42 for allowing only the flow of the air-fuel mixture M from the crankcase chamber 7 towards the valve chamber 18 is disposed within the drive transmitting passage (first passage) 24 and at the junction between it and the crankcase chamber 7. In addition, the intake check valve 34 shown as disposed in the intake passage 33 in FIG. 1 is dispensed with.

The four-cycle internal combustion engine of the structure shown in FIG. 5 is such that the air-fuel mixture M introduced from the air-fuel mixture producing device 32 into the valve chamber 18 through the intake passage 33 is circulated in a direction substantially reverse to that shown in and described with reference to FIG. 1. More specifically, the first and second check valves 38 and 43 employed in the combustion engine shown in FIG. 5 are so arranged and so positioned that the air-fuel mixture M introduced into the valve chamber 18 can flow in an annular circulating passage from the valve chamber 18 back to the valve chamber 18 through the auxiliary passage 41, then through the crankcase chamber 7 and finally through the drive transmitting passage 24.

The four-cycle internal combustion engine shown in FIG. 5 operates in the following manner.

During the intake stroke in which the piston 9 descends with the intake valve 19 then opened, the air-fuel mixture M containing the lubricant oil is introduced into the combustion chamber 44 through the intake port 40 and a fresh air-fuel mixture M is at the same time introduced from the air-fuel mixture producing device 32 into the valve chamber 18 and the intake port 40, communicated with the valve chamber 18, through the intake passage 33. The air-fuel mixture M introduced into the combustion chamber 44 is subsequently compressed during the compression stroke by the piston 9 then ascending within the cylinder bore 3*a*. On the other hand, since a negative pressure is developed within the crankcase chamber 7 as the piston 9 ascends, the first check valve 38 is opened to allow a portion of the air-fuel mixture M within the valve chamber 18 to flow into the crankcase chamber 7 through the auxiliary passage 41.

During the subsequent power or expansion stroke in which the air-fuel mixture then compressed within the combustion chamber 44 is ignited to expands, the first check valve 38 and the second check valve 42 are brought to closed and opened positions, respectively, in response to increase of the pressure inside the crankcase chamber 7 resulting from the descending motion of the piston 9. Accordingly, the air-fuel mixture M within the crankcase chamber 7 is fed under pressure towards the valve chamber 18 through the drive transmitting passage 24 to admix with the air-fuel mixture M fed from the air-fuel mixture producing device 32 through the intake passage 33.

During the exhaust stroke that follows the power stroke, the piston 9 ascends with the exhaust valve (not shown) then opened and, accordingly, combustion gases within the combustion chamber 44 are discharged as exhaust gases to the atmosphere through the exhaust port (not shown). At this time, a negative pressure is developed within the crankcase chamber 7 as a result of the ascending motion of the piston 9, with the first check valve 38 consequently brought to an opened position, allowing a portion of the air-fuel mixture M within the valve chamber 18 to flow into the crankcase chamber 7 through the auxiliary passage 41.

Thus, with the four-cycle internal combustion engine discussed above, the air-fuel mixture M circulates within the circulating passage in a direction substantially reverse to that shown in and described with reference to FIG. 1, but the combustion engine as a whole does function in a manner substantially similar thereto, bringing about effects similar to those afforded by the combustion engine of FIG. 1. Specifically, since in the combustion engine shown in and described with reference to FIG. 5 the air-fuel mixture M smoothly circulates within the circulating passage without being substantially stagnated, the lubricant oil contained in the air-fuel mixture M then circulating within the circulating passage is effectively utilized to lubricate the valve operating mechanism 30, including the valve drive unit 23 and the drive transmitting unit 29 and the various parts within the crankcase chamber 7. Therefore, the necessity of the oil sump is advantageously eliminated, making it possible to manufacture the combustion engine compact in size and light in weight. Also, the combustion engine of FIG. 5 can be operated in all positions without incurring any undesirable reduction in suction efficiency.

In addition to the various effects brought about thereby, the four-cycle internal combustion engine of the structure shown in and described with reference to FIG. 5 has one more advantage in that since arrangement has been made to prevent the air-fuel mixture M, which should flow from the valve chamber 18 into the auxiliary passage 41, from reversely entering the intake passage 33 and the use of the intake check valve 34 such as shown in FIG. 1 is eliminated as will be discussed in detail later, the structure of the combustion engine can further be simplified.

Figure 6:
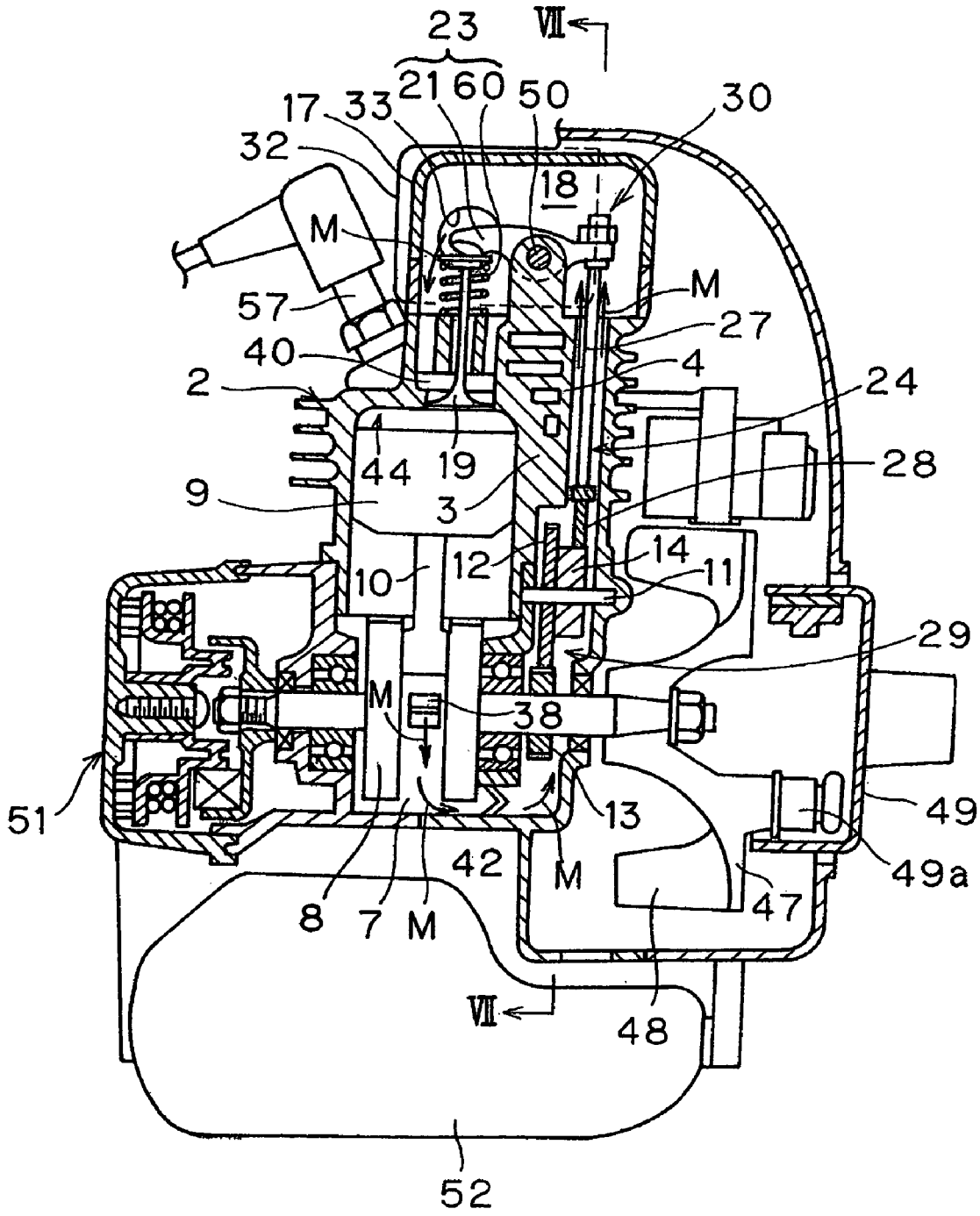
FIG. 6 is a longitudinal sectional view of the four-cycle combustion engine according to the second preferred embodiment of the present invention.

FIG. 6 illustrates another specific example in which the four-cycle internal combustion engine according to the second preferred embodiment, in which the principle shown in and described with reference to FIG. 5 is utilized, which engine is applied in the bush cutter. As can readily be understood from FIG. 6, the first check valve 38 is arranged at a substantially intermediate location with respect to the direction of height of the crankcase chamber 7 and the second check valve 42 is arranged at a bottom region of the crankcase chamber 7.

Figure 7:
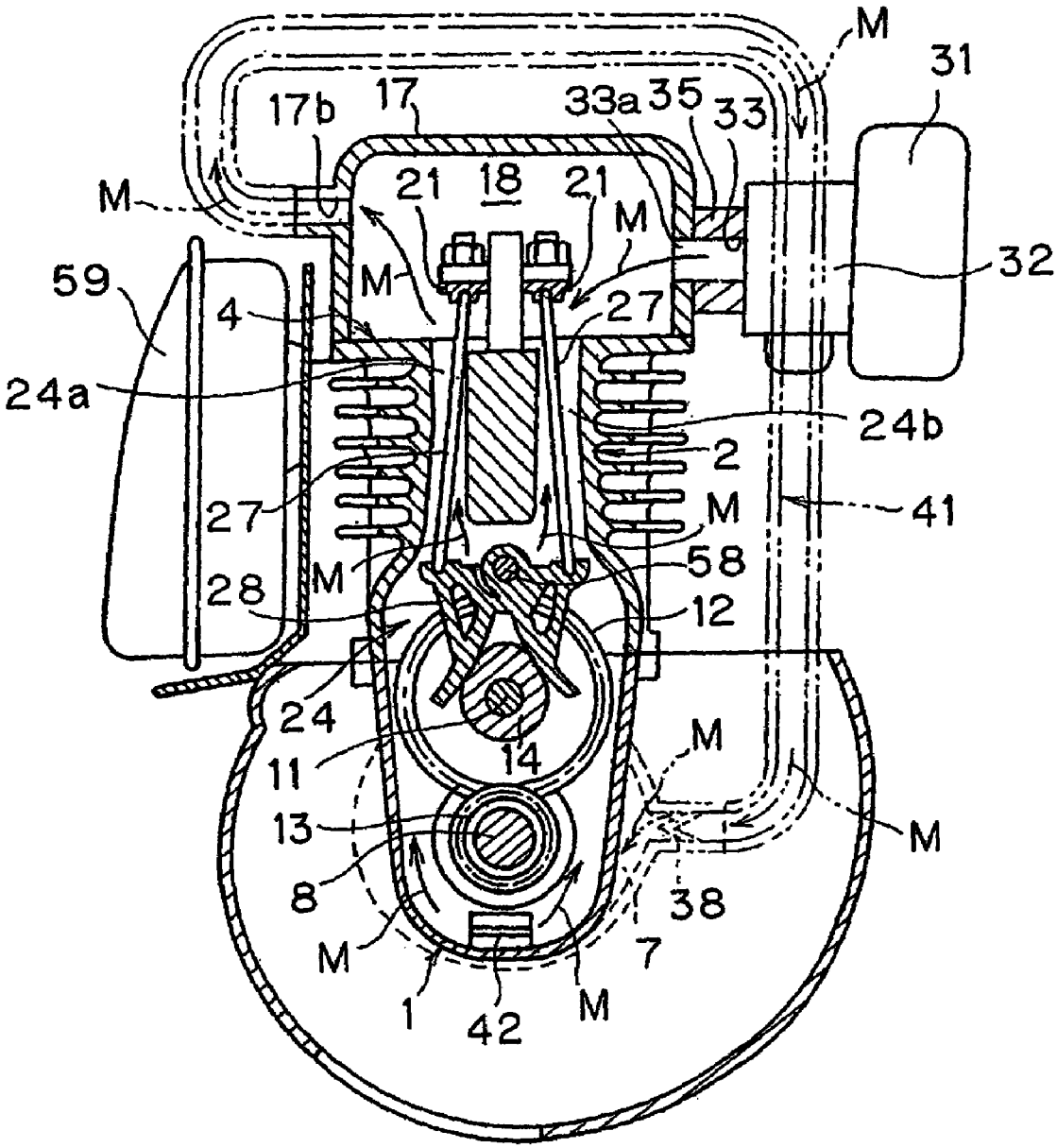
FIG. 7 is a cross-sectional view taken along the line VII—VII in FIG. 6.

As best shown in FIG. 7 showing a cross-sectional view taken along the line VII—VII in FIG. 6, the auxiliary passage 41 extending between the valve chamber 18 and the crankcase chamber 7 is fluid connected with a connection port 17*b* defined in the rocker cover 17 at a location opposite to or remote from an intake mouth 33*a* of the intake passage 33 which intake mouth 33*a* is opened to the valve chamber 18. Accordingly, since the air-fuel mixture M within the valve chamber 18 flows in a direction counter to the intake passage 33 and then into the auxiliary passage 41, there is no possibility of the air-fuel mixture M within the valve chamber 18 flowing reversely into the intake passage 33. In view of this, the intake check valve 34 (FIG. 1) shown and described as used in the intake passage 33 in the first embodiment of the present invention is dispensed with.

It is to be noted that in the foregoing second embodiment of the present invention, either one of the first and second check valves 38 and 42 may be dispensed with if so desired. The use of only one check valve can advantageously result in reduction in number of the component parts used, facilitating simplification in structure of the combustion engine as a whole and, hence, the combustion engine of the present invention can be easily manufactured compact and lightweight.

Figure 8:
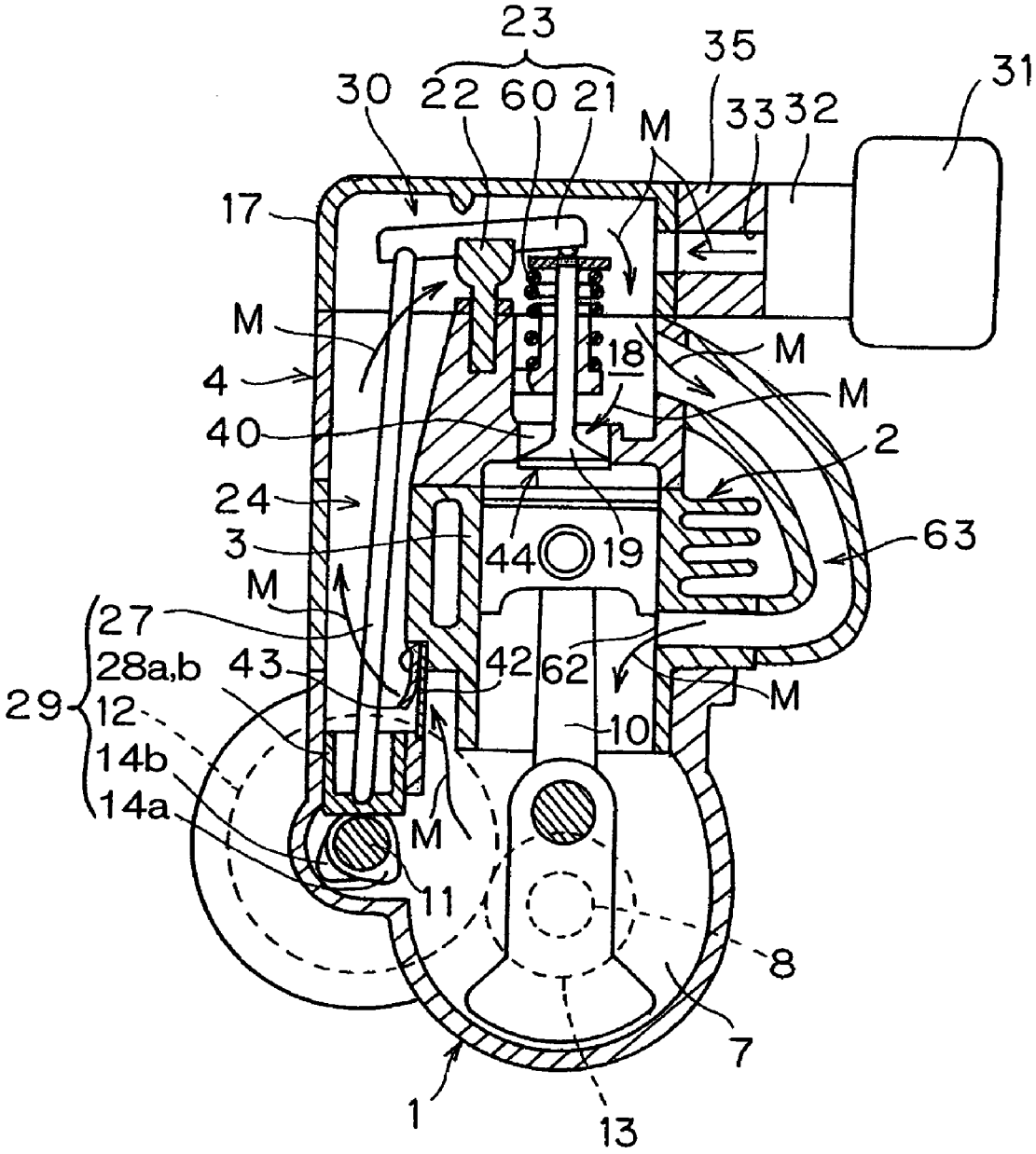
FIG. 8 is a schematic transverse sectional view showing the principle of a four-cycle combustion engine according to a third preferred embodiment of the present invention.

FIG. 8 illustrates a longitudinal sectional view of the four-cycle internal combustion engine according to a third preferred embodiment of the present invention. The combustion engine shown in FIG. 8 differs from that shown in FIG. 5 in that an inlet port 62 of FIG. 8 communicated with the crankcase chamber 7 and adapted to be selectively opened or closed by the piston 9 is defined in the engine cylinder 3 and in that in place of the auxiliary passage 41 and the first check valve 38 both employed in the embodiment of FIG. 5, a sub-passage (second passage) 63 of FIG. 8 is utilized to communicate the inlet port 62 with the valve chamber 18. In other words, the four-cycle internal combustion engine shown in FIG. 8, the piston 9 concurrently serves as a piston valve and, accordingly, the use of the first check valve (shown by 38 in FIG. 5) is eliminated.

The operation of the four-cycle internal combustion engine of the structure shown in FIG. 8 will now be described.

During the intake stroke in which the piston 9 descends with the intake valve 19 then opened, the air-fuel mixture M containing the lubricant oil is introduced into the combustion chamber 44 through the intake port 40 and a fresh air-fuel mixture M is at the same time introduced from the air-fuel mixture producing device 32 into the valve chamber 18 and the intake port 40, communicated with the valve chamber 18, through the intake passage 33. The air-fuel mixture M introduced into the combustion chamber 44 is subsequently compressed during the compression stroke by the piston 9 then ascending within the cylinder bore 3*a*. On the other hand, a negative pressure is developed within the crankcase chamber 7 as the piston 9 ascends and, when the piston 9 then ascending reaches a position sufficient to open the inlet port 62, a portion of the air-fuel mixture M within the valve chamber 18 starts flowing into the crankcase chamber 7 through the sub-passage 63.

During the subsequent power or expansion stroke, the pressure inside the crankcase chamber 7 increases from the moment the inlet port 62 is closed by the piston 9 then descending, accompanied by an eventual opening of the second check valve 42. As a result thereof, the air-fuel mixture M within the crankcase chamber 7 is fed under pressure to the valve chamber 18 through the drive transmitting passage 24 to admix with the fresh air-fuel mixture M fed from the air-fuel mixture producing device 32 through the intake passage 33.

During the exhaust stroke that follows the power stroke, the piston 9 ascends with the exhaust valve (not shown) then opened and, accordingly, combustion gases within the combustion chamber 44 are discharged as exhaust gases to the atmosphere through the exhaust port (not shown). Since at this time a negative pressure is developed within the crankcase chamber 7 as a result of the ascending motion of the piston 9, a portion of the air-fuel mixture M within the valve chamber 18 flows into the crankcase chamber 7 through the sub-passage 63 when the inlet port 62 is subsequently opened by the piston 9 then ascending.

As discussed above, the four-cycle internal combustion engine shown and described in connection with the third embodiment can provide effects and advantages similar to those afforded by the four-cycle internal combustion engine according to the second embodiment shown in and described with reference to FIG. 5. Specifically, since the air-fuel mixture M can flow in the circulating passage in one direction from the valve chamber 18 back to the valve chamber 18 through the sub-passage 63, then through the crankcase chamber 7 and finally through the drive transmitting passage 24 without being stagnated within the circulating passage, the lubricant oil contained in the air-fuel mixture M will not stagnate within the valve chamber 18 and can therefore be effectively utilized to lubricate the valve operating mechanism 30, including the valve drive unit 23 and the drive transmitting unit 29 and the various parts within the crankcase chamber 7.

Therefore, with the four-cycle internal combustion engine of the structure described above, the necessity of the oil sump is advantageously eliminated, making it possible to manufacture the combustion engine compact in size and light in weight. Also, such combustion engine can be operated in all positions without incurring any undesirable reduction in suction efficiency. In addition to those effects and advantages, such combustion engine is again advantageous in that the use of the first check valve 38 such as used in the combustion engine shown in and described with reference to FIG. 5 is eliminated.

It is to be noted that in the foregoing third embodiment of the present invention, the second check valve 42 in FIG. 8 may be dispensed with if so desired.

Figure 9:
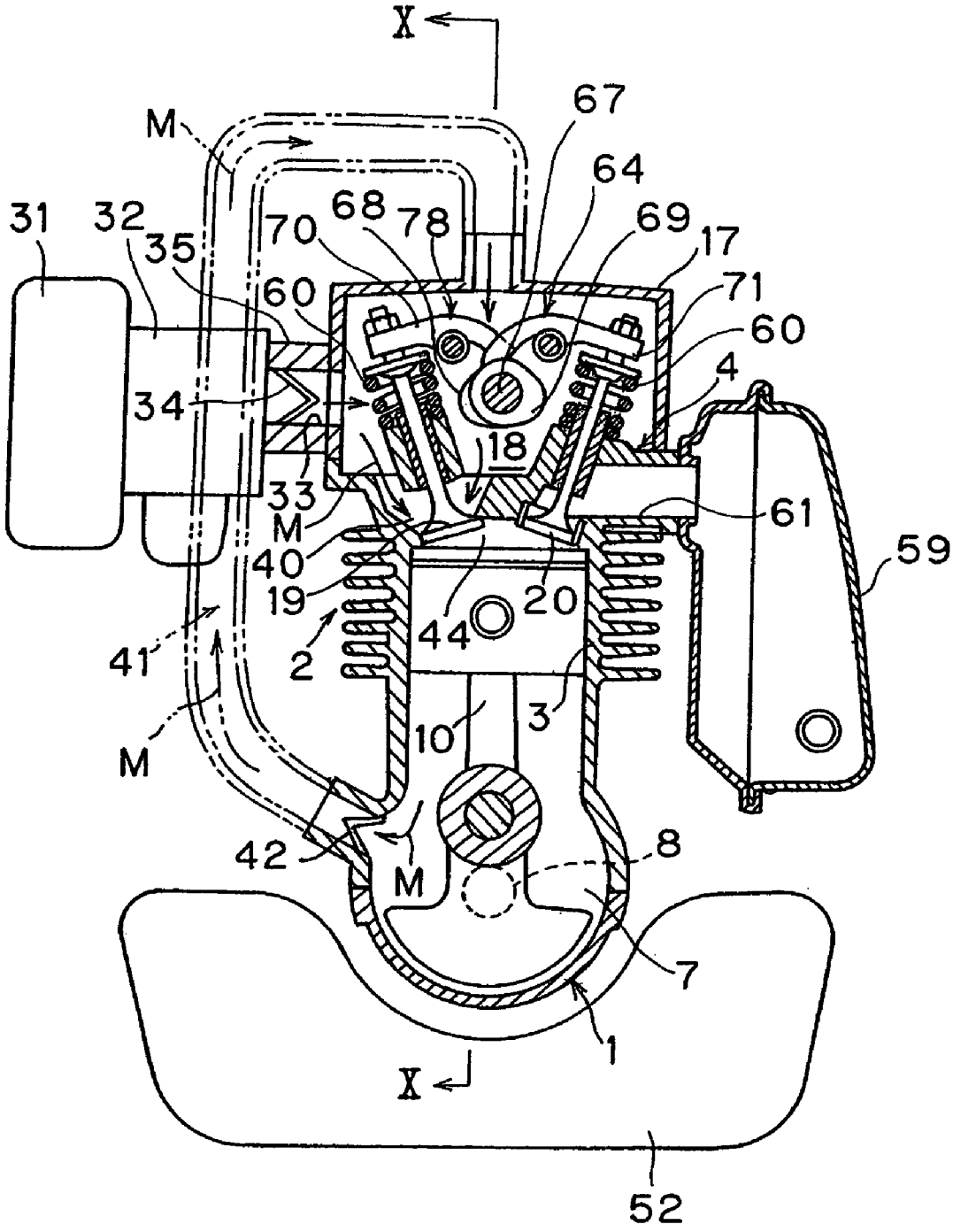
FIG. 9 is a transverse sectional view of the four-cycle combustion engine according to a fourth preferred embodiment of the present invention.

The four-cycle internal combustion engine according to a fourth preferred embodiment of the present invention is shown in a longitudinal sectional representation in FIG. 9. This fourth embodiment is a modified form of the first embodiment and differs from the first embodiment shown in and described with reference to FIGS. 1 to 4 in that in this fourth embodiment the combustion engine shown in FIG. 9 employs a valve operating mechanism 64 of an overhead cam shaft (OHC) system rather than the overhead valve system employed in the combustion engine according to the embodiments of FIGS. 1 to 4. More specifically, the valve operating mechanism 64 includes a cam shaft 67 rotatably supported by the cylinder head 4 within the valve chamber 18 and disposed between the intake valve 19 and the exhaust valve 20, intake and exhaust cams 68 fixed to the cam shaft 67 and rocker arms 70 and 71 engaged with the intake and exhaust cams 68 and 69 for selectively opening and closing the intake valve 19 and the exhaust valve 20 in an alternate sense.

Figure 10:
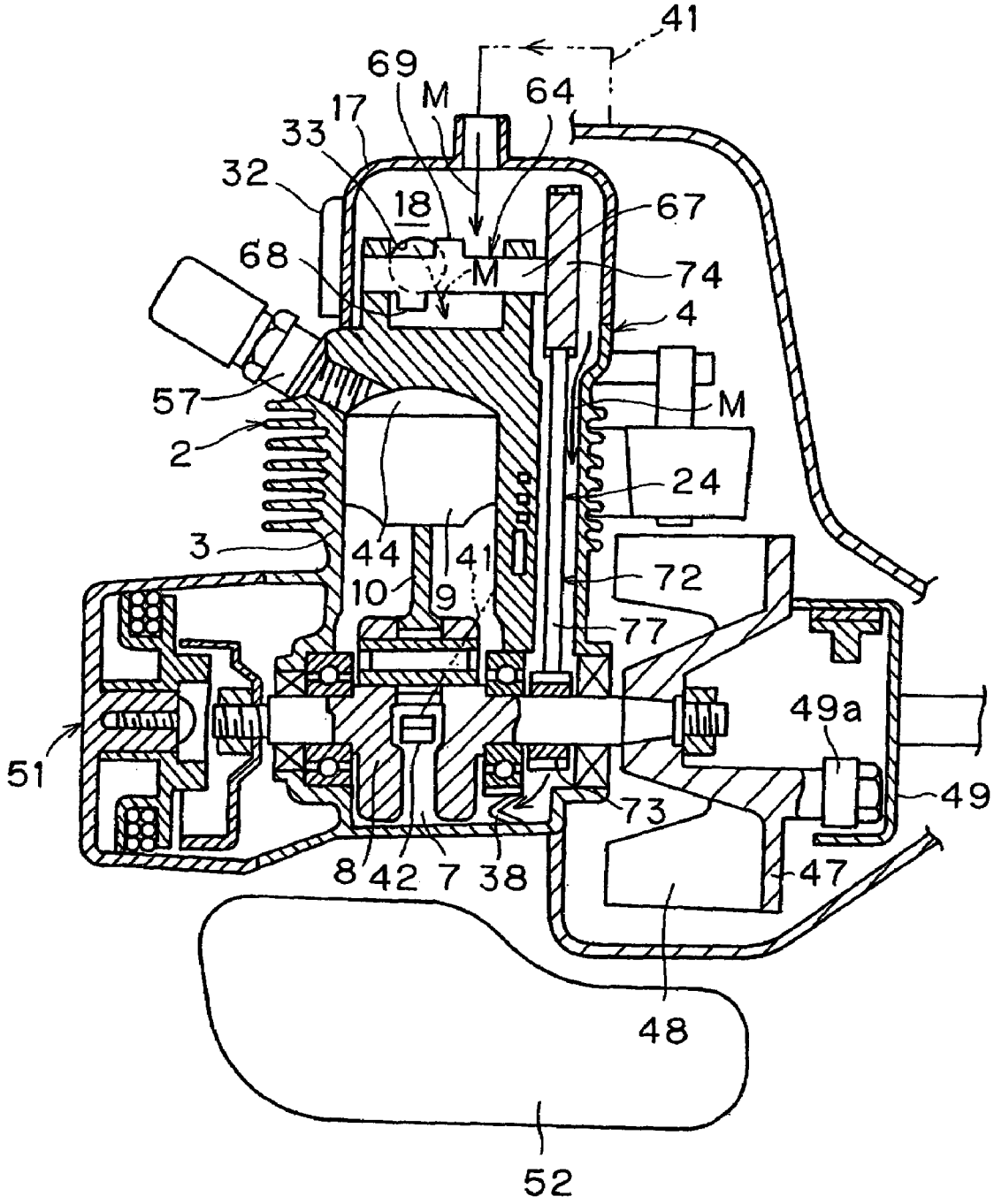
FIG. 10 is a cross-sectional view taken along the line X—X in FIG. 9.

FIG. 10 illustrates a cross-sectional view of the combustion engine taken along the line X—X in FIG. 9. As shown in FIG. 10, a drive transmitting unit 72 accommodated within the drive transmitting passage (first passage) 24 includes a drive gear 73 fixedly mounted on the crankshaft 8, a driven gear 74 fixedly mounted on the cam shaft 67, and a timing belt 77 trained between those gears 73 and 74. The first check valve 38 operable to allow only the flow of the air-fuel mixture M in a direction from the drive transmitting passage 24 towards the crankcase chamber 7 is disposed at a junction between the drive transmitting passage 24 and the crankcase chamber 7 and, on the other hand, the second check valve 42 (See FIG. 9) operable to allow only the flow of the air-fuel mixture M in a direction from the crankcase chamber 7 towards the auxiliary passage (second passage) 41 is disposed at a junction between the crank chamber 7 and the auxiliary passage 41.

Although the four-cycle internal combustion engine shown in FIGS. 9 and 10 is provided with the valve operating mechanism 64 of the overhead cam shaft type, it can provide effects and advantages similar to those afforded by the four-cycle internal combustion engine utilizing the valve operating mechanism 30 of the overhead valve type as shown in and described with reference to FIGS. 1 to 4. Specifically, while a portion of the air-fuel mixture fed from the air-fuel mixture producing device 32, shown in FIG. 9, into the valve chamber 18 and then into the intake port 40 is introduced into the combustion chamber 44 when the intake valve 19 is opened, another portion of that air-fuel mixture M circulates, by the effect of the reciprocating motion of the piston 9, through the circulating passage in a direction as shown by the arrow, i.e., from the valve chamber 18 back to the valve chamber 18 through the drive transmitting passage 24 (FIG. 10), then through the crankcase chamber 7 and finally through the auxiliary passage 41. Therefore, the air-fuel mixture M being circulated can smoothly flow without being stagnated within the circulating passage and the lubricant oil contained in the air-fuel mixture M will not stagnate within the valve chamber 18 of a relatively large capacity.

The lubricant oil contained in the air-fuel mixture M being circulated through the circulating passage is effectively utilized to lubricate the valve operating mechanism 64 including a valve drive unit 78 having the rocker arms 70 and 71, the cam shaft 67, the intake and exhaust cams 68 and 69, and two springs 60 associated respectively with the intake and exhaust valves 19 and 20, all accommodated within the valve chamber 18; the drive transmitting unit 72 including the drive and driven gears 73 and 74 and the timing belt 77 accommodated within the drive transmitting passage 24; and the various parts within the crankcase chamber 7. Also, the four-cycle internal combustion engine shown in FIGS. 9 and 10 can be operated in all positions.

In such four-cycle internal combustion engine, not only because the air-fuel mixture M from the air-fuel mixture producing device 32 is introduced directly into the valve chamber 18 and the intake port 40 communicated with the valve chamber 18, but also because the valve chamber 18 has a relatively large capacity, even the use of a portion of the supplied air-fuel mixture M for lubrication purpose does not result in variation of the internal pressure in the valve chamber 18. In addition, the air-fuel mixture M as supplied from the air-fuel mixture producing device 32 and the air-fuel mixture M having been utilized to lubricate the various parts within the crankcase chamber 7 admix together within the valve chamber 18, thereby increasing the amount of the air-fuel mixture M to be subsequently supplied to the intake port 40 and, accordingly, the supply of the air-fuel mixture M is in effect stabilized without the intake efficiency of the air-fuel mixture being lowered. Yet, since the fresh air-fuel mixture M as supplied from the air-fuel mixture producing device 32 to the valve chamber 18 serves to cool the valve operating mechanism 30 prior to being introduced into the crankcase chamber 7, it is clear that the valve operating mechanism 30 can be highly positively cooled.

It is to be noted that even in the fourth embodiment described above, either one of the first and second check valves 38 and 42 may be dispensed with if so desired.

Figure 11:
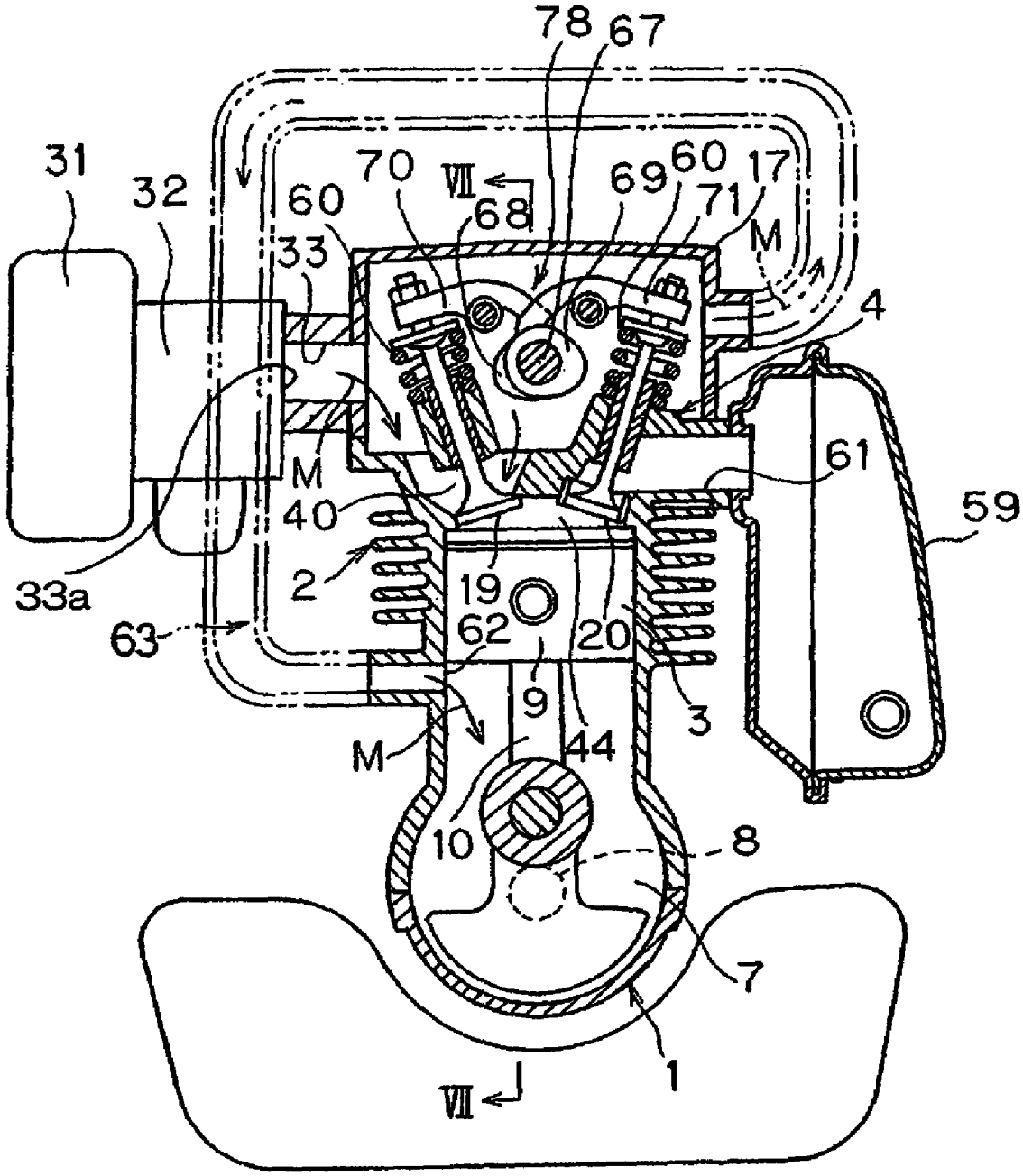
FIG. 11 is a transverse sectional view of the four-cycle combustion engine according to a fifth preferred embodiment of the present invention.
Figure 12:
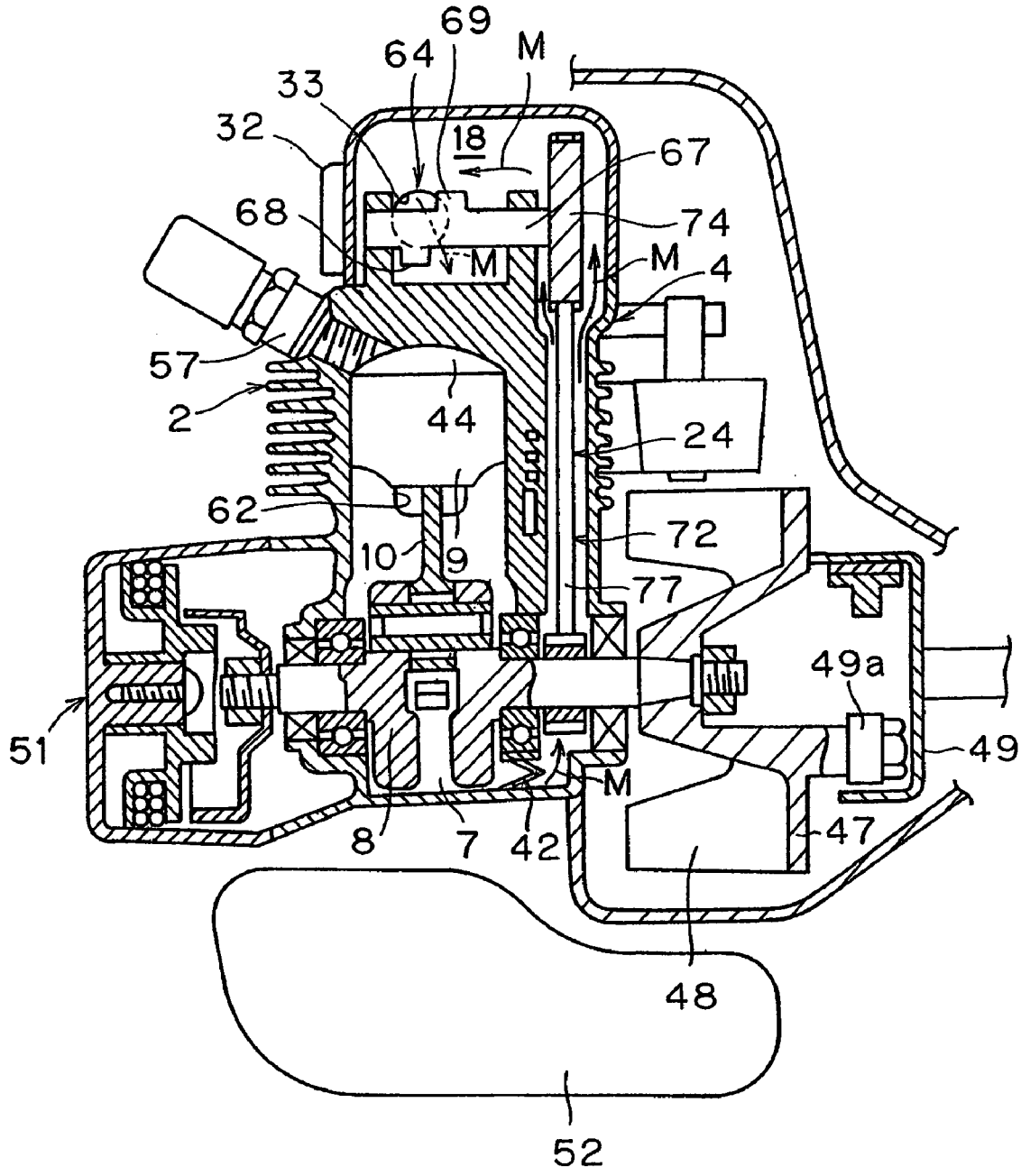
FIG. 12 is a cross-sectional view taken along the line XII—XII in FIG. 11.

FIG. 11 is a transverse sectional view of the four-cycle combustion engine according to a fifth preferred embodiment of the present invention and FIG. 12 is a cross-sectional view taken along the line XII—XII in FIG. 11. The four-cycle internal combustion engine according to this fifth embodiment may be a modified form of that according to the third embodiment shown in and described with reference to FIG. 8. Specifically, this fifth embodiment differs from the embodiment of FIGS. 9 and 10 in that in the four-cycle internal combustion engine shown in FIGS. 11 and 12, the air-fuel mixture M flows through the circulating passage in a direction substantially reverse to that in the four-cycle internal combustion engine of FIGS. 9 and 10 and in that the piston 9 in the embodiment shown in FIGS. 11 and 12 concurrently serves as a piston valve opening and closing the inlet port 62 and functioning in a manner similar to that of the first check valve 38 of FIG. 10. Except for those difference, the four-cycle internal combustion engine shown in FIGS. 11 and 12 can afford effects and advantages similar to those discussed hereinabove. In addition, as is the case with the embodiment shown in FIG. 8, the first check valve can be dispensed with.

It is to be noted that even in the fifth embodiment described above, the second check valve 42 may be dispensed with if so desired.

In any one of the foregoing embodiments of the present invention, each of the check valves 38 and 42 may be employed in the form of a reed valve for controlling the direction of flow of the air-fuel mixture M. It is, however, to be noted that in place of the reed valve, a rotary valve capable of being selectively opened and closed in synchronism with rotation of the crankshaft 8 may be employed.

Each of the first, second and fourth embodiments of the present invention has been described utilizing the first and second check valves 38 and 42 and each of the third and fifth embodiments of the present invention has been described utilizing the piston valve and the second check valve 42. It is, however, to be noted that if the connection ports for introduction and discharge of the air-fuel mixture M with respect to the crankcase chamber 7 are defined at respective predetermined positions offset relative to each other about the longitudinal axis of the piston 9, both of the first and second check valves 38 and 42 can advantageously be dispensed with. In other words, the connection port for introduction of the air-fuel mixture into the crank chamber 7 may be defined at a position where the negative pressure developed inside the crankcase chamber 7 as a result of the piston 9 ascending within the cylinder bore 3*a* can initially act strongly and the connection port for discharge of the air-fuel mixture M from the crankcase chamber 7 is then defined at a position where increase of the pressure inside the crankcase chamber 7 as a result of the piston 9 descending within the cylinder bore 3*a* can initially act strongly. In such case, even though both of the first and second check valves 38 and 39 are dispensed with, the air-fuel mixture M can flow in one direction through the circulating passage.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A four-cycle combustion engine which comprises:

a valve operating mechanism including a valve drive unit mounted on a cylinder head for driving intake and exhaust valves, and a drive transmitting unit for transmitting a rotary drive of a crankshaft, drivingly coupled with a piston, to the valve drive unit;

a valve chamber accommodating therein the valve drive unit and communicated with an intake port capable of being selectively opened or closed by the intake valve;

an intake passage for introducing into the valve chamber an air-fuel mixture containing lubricant oil;

a first passage accommodating therein the drive transmitting unit and communicating between the valve chamber and a crankcase chamber; and a second passage communicating between the crankcase chamber and the valve chamber;

wherein said valve chamber, said first passage, said crankcase chamber and said second passage cooperate with each other to define a circulating passage through which a portion of the air-fuel mixture from the intake passage is circulated as a result of a reciprocating motion of the piston.

2. The four-cycle combustion engine as claimed in claim 1, further comprising a check valve for controlling a direction of flow of the air-fuel mixture within the circulating passage.

3. The four-cycle combustion engine as claimed in claim 1, wherein the valve chamber is defined by a rocker cover mounted atop the cylinder head and further comprising an air-fuel mixture producing device disposed in the intake passage and arranged at a location laterally of the rocker cover.

4. The four-cycle combustion engine as claimed in claim 1, wherein the air-fuel mixture circulates in the circulating passage in one direction from the valve chamber back to the valve chamber through the first passage, then through the crankcase chamber and finally through the second chamber.

5. The four-cycle combustion engine as claimed in claim 4, further comprising at least one of a first check valve disposed at a junction between the first passage and the crankcase chamber for allowing a flow of the air-fuel mixture only in one direction from the first passage towards the crankcase chamber, and a second check valve disposed at a junction between the second passage and the crankcase chamber for allowing a flow of the air-fuel mixture only in one direction from the crankcase chamber towards the second passage.

6. The four-cycle combustion engine as claimed in claim 1, wherein the air-fuel mixture circulates in the circulating passage in one direction from the valve chamber back to the valve chamber through the second passage, then through the crankcase chamber and finally through the first passage.

7. The four-cycle combustion engine as claimed in claim 6, further comprising at least one of a first check valve disposed at a junction between the second passage and the crankcase chamber for allowing a flow of the air-fuel mixture only in one direction from the second passage towards the crankcase chamber, and a second check valve disposed at a junction between the first passage and the crankcase chamber for allowing a flow of the air-fuel mixture only in one direction from the crankcase chamber towards the first passage.

8. The four-cycle combustion engine as claimed in claim 6, wherein the second passage is fluid connected between the crankcase chamber and a portion of the valve chamber remote from an intake mouth opening to the valve chamber for introducing the air-fuel mixture from the intake passage into the valve chamber.

9. The four-cycle combustion engine as claimed in claim 1, wherein an inlet port is defined in a cylinder block, said inlet port being in communication with the crankcase chamber and capable of being selectively opened or closed by the piston reciprocatingly moving within the cylinder block, wherein the second passage is fluid connected between the valve chamber and the inlet port, and wherein the air-fuel mixture circulates in the circulating passage in one direction from the valve chamber back to the valve chamber through the second passage, then through the crankcase chamber and finally through the first passage.

10. The four-cycle combustion engine as claimed in claim 9, further comprising a check valve disposed at a junction between the first passage and the crankcase chamber for allowing a flow of the air-fuel mixture from the crankcase chamber towards the first passage.

11. The four-cycle combustion engine as claimed in claim 9, wherein the second passage is fluid connected between the crankcase chamber and a portion of the valve chamber remote from an intake mouth opening to the valve chamber for introducing the air-fuel mixture from the intake passage into the valve chamber.

* * * * *